US010446293B2

(12) United States Patent
Uegaki et al.

(10) Patent No.: US 10,446,293 B2
(45) Date of Patent: Oct. 15, 2019

(54) SHIELDED COMMUNICATION CABLE

(71) Applicants: AUTONETWORKS TECHNOLOGIES, LTD., Yokkaichi-shi, Mie (JP); SUMITOMO WIRING SYSTEMS, LTD., Yokkaichi-shi, Mie (JP); SUMITOMO ELECTRIC INDUSTRIES, LTD., Osaka-shi, Osaka (JP)

(72) Inventors: Ryoma Uegaki, Yokkaichi (JP); Kinji Taguchi, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/070,057

(22) PCT Filed: Nov. 4, 2016

(86) PCT No.: PCT/JP2016/082789
§ 371 (c)(1),
(2) Date: Jul. 13, 2018

(87) PCT Pub. No.: WO2017/168815
PCT Pub. Date: Oct. 5, 2017

(65) Prior Publication Data

US 2019/0013116 A1 Jan. 10, 2019

(30) Foreign Application Priority Data

Mar. 31, 2016 (JP) ..... 2016-071313

(51) Int. Cl.
*H01B 11/12* (2006.01)
*H01B 11/10* (2006.01)
(Continued)

(52) U.S. Cl.
CPC ..... *H01B 11/12* (2013.01); *H01B 7/02* (2013.01); *H01B 11/1033* (2013.01);
(Continued)

(58) Field of Classification Search
CPC ..... H01B 11/12; H01B 7/02; H01B 11/1033; H01B 11/1091; H01B 11/18; H01B 13/02; H01B 13/06; H01B 13/22
(Continued)

(56) References Cited

U.S. PATENT DOCUMENTS 3,522,112 A 7/1970 McLain
4,559,200 A 12/1985 Yamasaki et al.
(Continued)

FOREIGN PATENT DOCUMENTS

CN 1716463 A 1/2006
CN 103025905 A 4/2013
(Continued)

OTHER PUBLICATIONS

U.S. Appl. No. 16/070,048, filed Jul. 13, 2018 in the name of Ryoma Uegaki et al.
(Continued)

*Primary Examiner* — Timothy J Thompson
*Assistant Examiner* — Charles Pizzuto
(74) *Attorney, Agent, or Firm* — Oliff PLC

(57) ABSTRACT

A communication cable that has a reduced diameter while ensuring a required magnitude of characteristic impedance. The shielded communication cable contains a twisted pair containing a pair of insulated wires twisted with each other. Each of the insulated wire contains a conductor that has a
(Continued)

tensile strength of 400 MPa or higher, and an insulation coating that covers the conductor. The shielded communication cable 1 further contains a shield that is made of a conductive material and surrounds the twisted pair. The shielded communication cable has a characteristic impedance of 100±10Ω.

11 Claims, 1 Drawing Sheet

(51) Int. Cl.

| | |
|---|---|
| ***H01B 11/18*** | (2006.01) |
| ***H01B 7/02*** | (2006.01) |
| ***H01B 13/02*** | (2006.01) |
| ***H01B 13/22*** | (2006.01) |
| ***H01B 13/06*** | (2006.01) |

(52) U.S. Cl.
CPC ..... *H01B 11/1091* (2013.01); *H01B 11/18* (2013.01); *H01B 13/02* (2013.01); *H01B 13/06* (2013.01); *H01B 13/22* (2013.01)

(58) Field of Classification Search
USPC ..... 174/102 R
See application file for complete search history.

(56) References Cited

U.S. PATENT DOCUMENTS

| | | | | |
|---|---|---|---|---|
| 4,777,325 | A | 10/1988 | Siwinski | |
| 5,142,121 | A * | 8/1992 | Ezaki | H02G 1/128 219/121.85 |
| 5,399,813 | A | 3/1995 | McNeill et al. | |
| 5,424,491 | A | 6/1995 | Walling et al. | |
| 5,597,981 | A | 1/1997 | Hinoshita et al. | |
| 5,600,097 | A | 2/1997 | Bleich et al. | |
| 5,606,151 | A | 2/1997 | Siekierka et al. | |
| 5,821,467 | A | 10/1998 | O'Brien et al. | |
| 6,096,977 | A | 8/2000 | Beggs et al. | |
| 6,153,826 | A | 11/2000 | Kenny et al. | |
| 6,211,467 | B1 | 4/2001 | Berelsman et al. | |
| 6,222,129 | B1 | 4/2001 | Siekierka et al. | |
| 6,242,097 | B1 | 6/2001 | Nishiguchi et al. | |
| 6,323,427 | B1 | 11/2001 | Rutledge | |
| 6,365,838 | B1 | 4/2002 | Rutledge et al. | |
| 6,555,753 | B2 * | 4/2003 | Rutledge | H01B 7/0009 174/128.1 |
| 6,627,009 | B1 * | 9/2003 | Matsui | C22C 9/00 148/433 |
| 6,815,611 | B1 | 11/2004 | Gareis | |
| 7,030,321 | B2 | 4/2006 | Clark | |
| 7,214,884 | B2 | 5/2007 | Kenny et al. | |
| 7,507,909 | B2 | 3/2009 | Federighi et al. | |
| 8,431,825 | B2 | 4/2013 | Gareis | |
| 8,872,031 | B2 | 10/2014 | Hinoshita et al. | |
| 9,805,844 | B2 | 10/2017 | Bopp et al. | |
| 2002/0044881 | A1 | 4/2002 | Breedis et al. | |
| 2004/0112628 | A1 | 6/2004 | Brandi et al. | |
| 2004/0166017 | A1 | 8/2004 | Caron et al. | |
| 2004/0238086 | A1 | 12/2004 | Saleh | |
| 2006/0169479 | A1 | 8/2006 | Dillon et al. | |
| 2007/0068696 | A1 | 3/2007 | Matsui et al. | |
| 2010/0108349 | A1 | 5/2010 | Baeck et al. | |
| 2010/0200267 | A1 * | 8/2010 | Baeck | H01B 11/06 174/110 R |
| 2011/0048764 | A1 | 3/2011 | Hira et al. | |
| 2012/0000690 | A1 | 1/2012 | Van Der Meer | |
| 2013/0092437 | A1 * | 4/2013 | Yoshinaga | C22C 9/00 174/75 R |
| 2014/0262424 | A1 * | 9/2014 | Liptak | H01B 11/002 174/106 R |
| 2014/0273594 | A1 | 9/2014 | Jones et al. | |
| 2014/0353002 | A1 | 12/2014 | Placke et al. | |
| 2015/0144375 | A1 | 5/2015 | Hashimoto et al. | |
| 2015/0255928 | A1 | 9/2015 | Liptak et al. | |
| 2015/0371726 | A1 | 12/2015 | Inoue et al. | |
| 2016/0133355 | A1 | 5/2016 | Glew et al. | |
| 2016/0284437 | A1 | 9/2016 | Inoue et al. | |

FOREIGN PATENT DOCUMENTS

| | | | |
|---|---|---|---|
| CN | 104700932 | A | 6/2015 |
| CN | 204792164 | U | 11/2015 |
| DE | 1783 163 | A1 | 7/1973 |
| EP | 1 580 767 | A2 | 9/2005 |
| EP | 3 103 122 | B1 | 7/2018 |
| JP | H06-060740 | A | 3/1994 |
| JP | H07-57561 | A | 3/1995 |
| JP | H08-507900 | A | 8/1996 |
| JP | H08-241631 | A | 9/1996 |
| JP | 2001-148206 | A | 5/2001 |
| JP | 2002-510138 | A | 4/2002 |
| JP | 2003-36739 | A | 2/2003 |
| JP | 2005-32583 | A | 2/2005 |
| JP | 2008-130347 | A | 6/2008 |
| JP | 2011-96505 | A | 5/2011 |
| JP | 2012-146431 | A | 8/2012 |
| JP | 2013-098127 | A | 5/2013 |
| JP | 2015-130326 | A | 7/2015 |
| JP | 2012-146431 | * | 9/2015 |
| JP | 2015-170431 | A | 9/2015 |
| KR | 100708417 | B1 | 4/2007 |
| KR | 100825408 | B1 | 4/2008 |
| KR | 20140142671 | * | 12/2014 |
| WO | 2000074079 | A1 | 12/2000 |
| WO | 2008/127579 | A1 | 10/2008 |
| WO | 2015093317 | A1 | 6/2015 |

OTHER PUBLICATIONS

Dec. 13, 2016 International Search Report issued in International Patent Application No. PCT/JP2016/082789.
Dec. 27, 2016 International Search Report issued in International Patent Application No. PCT/JP2016/085960.
Mar. 12, 2019 Office Action issued in corresponding Chinese Patent Application No. 201680082773.6.
Nov. 13, 2018 Japanese Office Action issued in Japanese Patent Application No. 2018-508394.
Mar. 4, 2019 Office Action issued U.S. Appl. No. 16/070,048.
Dec. 13, 2018 Office Action issued in Korean Patent Application No. 10-2018-7022375.
Mar. 21, 2019 Office Action issued in U.S. Appl. No. 15/565,526.
Jun. 1, 2018 Office Action issued in U.S. Appl. No. 15/565,526.
Oct. 22, 2018 Office Action issued in U.S Appl. No. 15/565,526.
Blattenberger; "Dielectric Constant, Strength, & Loss Tangent"; http://www.rfcafe.com/references/electrical/dielectric-constants-strengths.htm; Oct. 15, 2008.
LaPointe; "Electrical Properties of Plastics"; http://users.tm.net/lapointe/Plastics.htm; Aug. 28, 2001.
Apr. 15, 2019 German Office Action issued in German Patent Application No. 11 2016 006 142.0.
May 28, 2019 Office Action issued in Chinese Patent Application No. 201680083363.3.
May 20, 2019 Office Action issued in Chinese Patent Application No. 201680083365.2.
Jun. 28, 2019 Office Action issued in U.S. Appl. No. 15/565,526.
Jul. 30, 2019 Office Action Issued in U.S. Appl. No. 16/070,048.
Aug. 13. 2019 Office Action issued in Chinese Application No. 201680082773.6.

* cited by examiner

SHIELDED COMMUNICATION CABLE

TECHNICAL FIELD

The present invention relates to a shielded communication cable, and more specifically to a shielded communication cable that can be used for high-speed communication such as in an automobile.

BACKGROUND ART

Demand for high-speed communication is increasing in fields such as of automobiles. Transmission characteristics of a cable used for high-speed communication such as a characteristic impedance thereof have to be controlled strictly. For example, a characteristic impedance of a cable used for Ethernet communication has to be controlled to be 100±10Ω.

A characteristic impedance of a cable depends on specific features thereof such as a diameter of a conductor and type and thickness of an insulation coating. For example, Patent Document 1 discloses a shielded communication cable containing a twisted pair that contains a pair of insulated cores twisted with each other, each insulated core containing a conductor and an insulator covering the conductor. The cable further contains a metal-foil shield covering the twisted pair, a grounding wire electrically continuous with the shield, and a sheath that covers the twisted pair, the grounding wire, and the shield together. The cable has a characteristic impedance of 100±10Ω. The insulated cores used in Patent Document 1 have a conductor diameter of 0.55 mm, and the insulator covering the conductor has a thickness of 0.35 to 0.45 mm.

CITATION LIST

Patent Literature

Patent Document 1: JP 2005-32583 A

SUMMARY OF INVENTION

Technical Problem

There exists a great demand for reduction of a diameter of a communication cable installed such as in an automobile. To satisfy the demand, the size of the shielded communication cable has to be reduced with satisfying required transmission characteristics including characteristic impedance. A possible method for reducing the diameter of a shielded communication cable containing a twisted pair is to make insulation coatings of insulated wires constituting the twisted pair thinner. According to investigation by the present inventors, however, if the thickness of the insulator in the shielded communication cable disclosed in Patent Document 1 is made smaller than 0.35 mm, the characteristic impedance falls below 90Ω. This is out of the range of 100±10Ω, which is required for Ethernet communication.

An object of the present invention is to provide a shielded communication cable that has a reduced diameter while ensuring a required magnitude of characteristic impedance.

Solution to Problem

To achieve the object and in accordance with the purpose of the present invention, a shielded communication cable according to the present invention contains a twisted pair containing a pair of insulated wires twisted with each other. Each of the insulated wire contains a conductor that has a tensile strength of 400 MPa or higher and an insulation coating that covers the conductor. The shielded communication cable contains a shield that is made of a conductive material and surrounds the twisted pair. The cable has a characteristic impedance of 100±10Ω.

It is preferable that each of the insulated wires has a conductor cross-sectional area smaller than 0.22 $mm^2$. It is preferable that the insulation coating of each of the insulated wires has a thickness of 0.35 mm or smaller. It is preferable that each of the insulated wires has an outer diameter of 1.15 mm or smaller. It is preferable that the conductor of each of the insulated wires has a breaking elongation of 7% or higher.

It is preferable that the shield is a braided shield. Otherwise, it is preferable that the shield is a metal foil shield, and the cable further contains a grounding wire electrically continuous with the shield within an area surrounded by the shield.

Advantageous Effects of Invention

In the above-described shielded communication cable, since the conductor of each of the insulated wires constituting the twisted pair has the high tensile strength of 400 MPa or higher, the diameter of the conductor can be reduced while sufficient strength required for an electric wire is ensured. Thus, the distance between the two conductors constituting the twisted pair is reduced, whereby the characteristic impedance of the shielded communication cable can be increased. As a result, the characteristic impedance of the shielded communication cable can be ensured in the range of 100±10Ω, without falling below the range, even when the insulation coating of each of the insulated wires is made thin to reduce the diameter of the shielded communication cable.

When each of the insulated wires has the conductor cross-sectional area smaller than 0.22 $mm^2$, the characteristic impedance of the communication cable is increased due to the effect of reduction of the distance between the two insulated wires constituting the twisted pair, whereby reduction of the diameter of the shielded communication cable by reduction of the thickness of the insulation coating is facilitated while ensuring the required characteristic impedance. Further, the small diameter of each of the conductor itself has the effect of reducing the diameter of the shielded communication cable.

When the insulation coating of each of the insulated wires has the thickness of 0.35 mm or smaller, the diameter of each of the insulated wires is sufficiently small, whereby the diameter of the whole shielded communication cable can effectively be made small.

Also when each of the insulated wires has the outer diameter of 1.15 mm or smaller, the diameter of the entire shielded communication cable can effectively be made small.

When the conductor of each of the insulated wires has the breaking elongation of 7% or higher, the conductor has a high impact resistance, whereby the conductor well resists the impact applied to the conductor when the shielded communication cable is processed into a wiring harness or when the wiring harness is installed.

When the shield is the braided shield, the shielded communication cable need not contain a grounding wire because the braided shield can be grounded directly. Thus, the shielded communication cable can have a simple structure and a reduced diameter.

When the shield is the metal foil shield, and the cable further contains the grounding wire electrically continuous with the shield within the area surrounded by the shield, the diameter of the shielded communication cable can be effectively reduced by the small thickness of the metal foil shield.

DESCRIPTION OF EMBODIMENTS

A detailed description of a shielded communication cable according to a preferred embodiment of the present invention will now be provided.

First Embodiment

Figure 1:
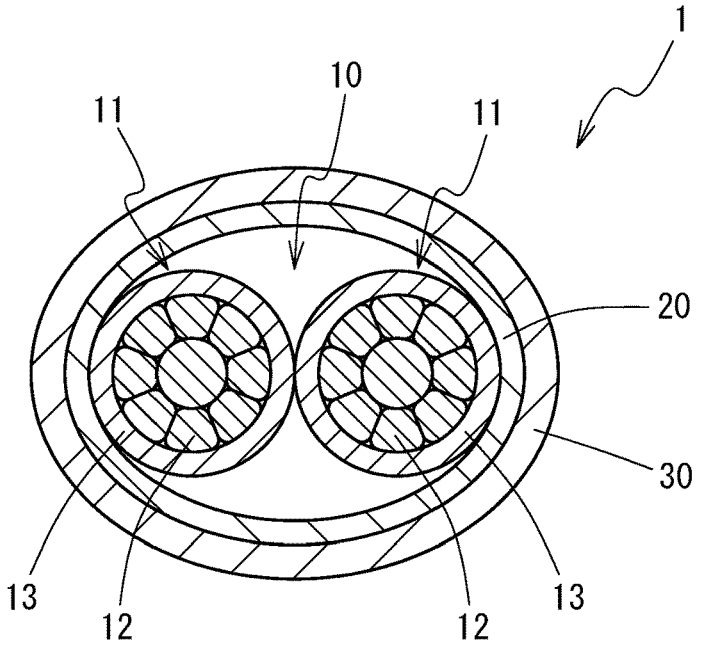
FIG. 1 is a cross-sectional view showing a shielded communication cable according to a first embodiment of the present invention.

FIG. 1 shows a cross-sectional view of the shielded communication cable 1 according to the first embodiment of the present invention.

The shielded communication cable 1 contains a twisted pair 10 that contains a pair of insulated wires 11, 11 twisted with each other. Each of the insulated wires 11 contains a conductor 12 and an insulation coating 13 that covers the conductor 12 on the outer surface of the conductor 12. The shielded communication cable 1 further contains a braided shield 20 as a shield that is made of a conductive material and surrounds the twisted pair 10. Further, the communication cable 1 contains a sheath 30 that is made of an insulating material and covers the braided shield 20 on the outer periphery of the twisted pair 10.

The shielded communication cable 1 has a characteristic impedance of 100±10Ω. A characteristic impedance of 100±10Ω is required for a cable used for Ethernet communication. Having the characteristic impedance, the shielded communication cable 1 can be used suitably for high-speed communication such as in an automobile.

The conductors 12 of the insulated wires 11 constituting the twisted pair 10 are metal wires having a tensile strength of 400 MPa or higher. Specific examples of the metal wires include copper alloy wires containing Fe and Ti, which are illustrated later. The tensile strength of the conductors 12 is preferably 440 MPa or higher, and more preferably 480 MPa or higher.

Since the conductors 12 have the tensile strength of 400 MPa or higher, the conductors can maintain a tensile strength that is required for electric wires even when the diameter of the conductors 12 is reduced. When the diameter of the conductors 12 is reduced, the distance between the two conductors 12, 12 constituting the twisted pair 10 (i.e., the length of the line connecting the centers of the conductors 12, 12 with each other) is reduced, whereby the characteristic impedance of the shielded communication cable 1 is increased. For example, the diameter of the conductors 12 can be as small as providing a conductor cross-sectional area smaller than 0.22 $mm^2$, and more preferably a conductor cross-sectional area of 0.15 $mm^2$ or smaller, or 0.13 $mm^2$ or smaller. The outer diameter of the conductors 12 can be 0.50 mm or smaller. If the diameter of the conductors 12 is too small, however, the conductors 12 can hardly have sufficient strength, and the characteristic impedance of the communication cable 1 may be too high. Thus, the conductor cross-sectional area of the conductors 12 is preferably 0.08 $mm^2$ or larger.

When the conductors 12 have a small conductor cross-sectional area smaller than 0.22 $mm^2$, characteristic impedance of 100±10Ω can be ensured well for the shielded communication cable 1 even if the thickness of the insulation coatings 13 covering the conductors 12 are reduced, for example, to 0.35 mm or smaller. Conventional copper electric wires are hard to be used with a conductor cross-sectional area smaller than 0.22 $mm^2$ because the wires have lower tensile strengths.

It is preferable that the conductors 12 should have a breaking elongation of 7% or higher. Generally, a conductor having a high tensile strength has low toughness, and thus exhibits low impact resistance when a force is applied to the conductor rapidly. If the above-described conductors 12 having the high tensile strength of 400 MPa or higher have a breaking elongation of 7% or higher, however, the conductors 12 can exhibit excellent resistance to impacts applied to the conductors 12 when the communication cable 1 is processed to a wiring harness or when the wiring harness is installed.

The conductors 12 may each consist of single wires; however, it is preferable in view of having high flexibility that the conductors 12 should consist of strand wires each containing a plurality of elemental wires stranded with each other. In this case, the conductors 12 may be compressed strands formed by compression of strand wires after stranding of the elemental wires. The outer diameter of the conductors 12 can be reduced by the compression. Further, when the conductors 12 are strand wires, the conductors 12 may consist of single type of elemental wires or of two or more types of elemental wires as long as the whole conductors 12 each have the tensile strength of 400 MPa or higher. Example of the conductors 12 consisting of two or more types of elemental wires include conductors that contain below-described copper alloy wires containing Fe and Ti and further contain elemental wires made of a metal material other than a copper alloy such as SUS.

The insulation coatings 13 of the insulated wires 11 may be made of any kind of polymer material. It is preferable that the insulation coatings 13 should have a relative dielectric constant of 4.0 or smaller in view of ensuring the required high characteristic impedance. Examples of the polymer material having the relative dielectric constant include polyolefin such as polyethylene and polypropylene, polyvinyl chloride, polystyrene, polytetrafluoroethylene, and polyphenylenesulfide. Further, the insulation coatings 13 may contain additives such as a flame retardant in addition to the polymer material.

The characteristic impedance of the shielded communication cable 1 is increased by reduction of the diameter of the conductors 12 and consequent closer location of the two conductors 12, 12. As a result, the thickness of the insulation coatings 13 that is required to ensure the required characteristic impedance can be reduced. For example, the thickness of the insulation coatings 13 is preferably 0.35 mm or smaller, more preferably 0.30 mm or smaller, and still more preferably 0.25 mm or smaller. If the insulation coatings 13 are too thin, however, it may be hard to ensure the required high characteristic impedance. Thus, the thickness of the insulation coatings 13 is preferably 0.20 mm or larger.

The whole diameter of the insulated wires 11 is reduced by reduction of the diameter of the conductors 12 and the thickness of the insulation coatings 13. For example, the outer diameter of the insulated wires 11 can be 1.15 mm or smaller, and more preferably 1.05 mm or smaller. Reduction of the diameter of the insulated wires 11 serves to reduce the diameter of the communication cable 1 as a whole.

The braided shield 20 is made of thin metal elemental wires braided into the shape of a hollow cylinder. The elemental wires are made of a metal material such as copper, a copper alloy, aluminum, or an aluminum alloy, or a material having a plated layer on the surface of the metal material. The braided shield 20 plays roles of shielding the twisted pair 10 from outside noises and stopping noises released from the twisted pair 10 to the outside. The configuration of the braided shield 20 (such as the number of carriers, number of wires per carrier, and pitch) may be selected appropriately according the required shielding property.

The sheath 30 may be made of any kind of polymer material similarly with the insulation coatings 13 of the insulated wires 11. Examples of the polymer material include polyolefin such as polyethylene and polypropylene, polyvinyl chloride, polystyrene, polytetrafluoroethylene, and polyphenylenesulfide. The sheath 30 may contain additives such as a flame retardant in addition to the polymer material as necessary. The sheath 30 plays roles of protecting the braided shield 20 and maintaining the twist structure of the twisted pair. However, it is not mandatory for the communication cable 1 to have the sheath 30, but the sheath 30 may be omitted when no problem is caused by the omission of the sheath 30.

As described above, since the conductors 12 of the insulated wires 11 constituting the twisted pair 10 of the shielded communication cable 1 have a tensile strength of 400 MPa or higher, sufficient strength for the use in an automobile can be ensured well for the communication cable 1 even when the diameter of the conductors 12 is reduced. When the conductors 12 have a reduced diameter, the distance between the two conductors 12, 12 in the twisted pair 10 is reduced. When the distance between the two conductors 12, 12 is reduced, the characteristic impedance of the shielded communication cable 1 is increased. When the insulated wires 11 constituting the twisted pair 10 have thinner insulation coatings 13, the shielded communication cable 1 has a lower characteristic impedance; however, in the present embodiment, the reduced distance between the conductors 12, 12 realized by their reduced diameter can ensure the characteristic impedance of 100±10Ω for the shielded communication cable 1 even with a small thickness of the insulation coatings 13, for example, of 0.35 mm or smaller.

Making the insulation coatings 13 of the insulated wires 11 thinner leads to reduction of the diameter (i.e. finished diameter) of the shielded communication cable 1 as a whole. The shielded communication cable 1, having the reduced diameter while ensuring the required characteristic impedance, can be suitably used for high-speed communication in a limited space such as in an automobile.

In the second embodiment illustrated next, a metal foil shield 40 is used as a shield made of a conductive material instead of the braided shield 20. Thickness of the shield tends to be larger when the braided shield 20 is used as in the present first embodiment than in the case where the metal foil shield 40 is used. The braided shield 20 can, however, be directly grounded through expansion thereof whereas the metal foil shield 40 can not be directly grounded and thus requires a grounding wire 50. The grounding wire 50 can be omitted when the braided shield 20 is used. The entire structure of the shielded communication cable 1 is simplified by the omission of the grounding wire 50, whereby the diameter of the entire shielded communication cable 1 can be reduced.

Second Embodiment

Figure 2:
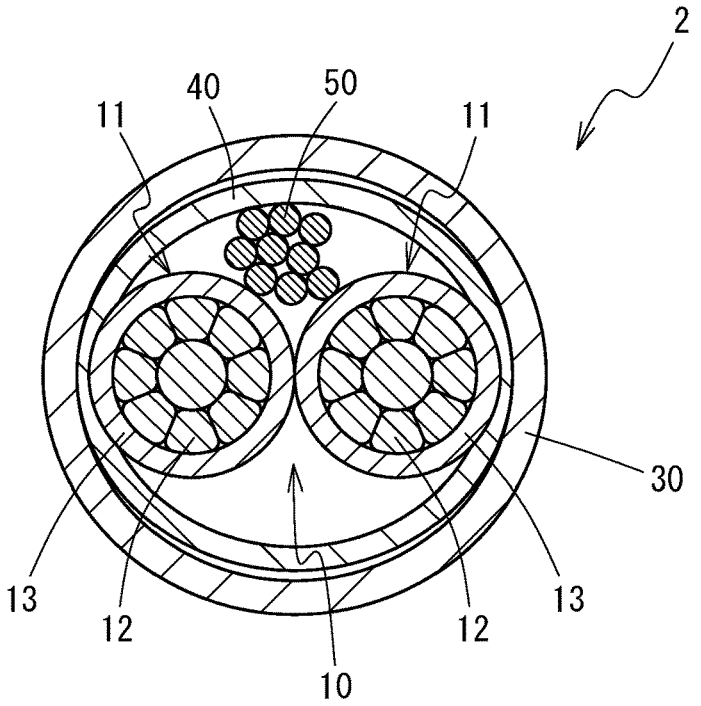
FIG. 2 is a cross-sectional view showing a shielded communication cable according to a second embodiment of the present invention.

FIG. 2 shows a cross-sectional view of the communication cable 2 according to the second embodiment of the present invention.

The shielded communication cable 2 according to the second embodiment contains a metal foil shield 40 as a shield instead of the braided shield 20 contained in the shielded communication cable 1 according to the above-described first embodiment. The shielded communication cable 2 further contains a grounding wire 50 within the area surrounded by the metal foil shield 40 together with the twisted pair 10. The shielded communication cable 2 has the same structure as the shielded communication cable 1 according to the first embodiment except that the cable 2 has the metal foil shield 40 and the grounding wire 50; the explanation of the structure will be omitted.

The metal foil shield 40 is a foil made of a material such as copper, a copper alloy, aluminum, or an aluminum alloy. The metal foil surrounds the twisted pair 10 and the grounding wire 50 together. The thickness of the metal foil shield 40 may be selected appropriately according the required shielding property.

The grounding wire 50 is made of conductive wire(s). The grounding wire 50 is twisted with the pair of insulated wires 11,11 in the twisted pair 10 or may be put along the twisted pair 10. The elemental wire(s) constituting the grounding wire 50 are made of a metal material such as copper, a copper alloy, aluminum, or an aluminum alloy, or a material having a plated layer such as a tin-plated layer on the surface of the metal material. The grounding wire 50 may consist of a single elemental wire, but it is preferable that the grounding wire 50 consists of a twisted wire that contains a plurality of elemental wires twisted together in view of having sufficient strength.

The grounding wire 50 is in contact with the metal foil shield 40 and is electrically consistent with the metal foil shield 40. When the shielded communication cable 2 is used, the metal foil shield 40 can be grounded through the grounding wire 50.

The metal foil shield 40 has a smaller thickness and can be put closer to the twisted pair 10 than the braided shield 20 contained in the shielded communication cable 1 according to the first embodiment. Thus, the shielded communication cable 2 can reduce the entire diameter thereof more effectively by containing the metal foil shield 40 instead of the braided shield 20. Further, the metal foil shield 40 is available at a lower cost than the braided shield 20.

Material of Conductors

A description of specific examples of the copper alloy wires to be used as conductors 12 of the insulated wires 11 in the shielded communication cable 1 according to the above-described first and second embodiments will be provided below.

Copper alloy wires in the first and second embodiments has the following ingredients composition:

Fe: 0.05 mass % or more and 2.0 mass % or less;

Ti: 0.02 mass % or more and 1.0 mass % or less;

Mg: 0 mass % or more and 0.6 mass % or less (including a case where Mg is not contained in the alloy); and a balance being Cu and unavoidable impurities.

The copper alloy wires having the above-described ingredients composition have a very high tensile strength. Particularly when the copper alloy wires contain 0.8 mass % or more of Fe or 0.2 mass % or more of Ti, an especially high tensile strength is achieved. Further, the tensile strength of the wires may be improved when the diameter of the wires is reduced by increasing drawing reduction ratio or when the wires are subjected to a heat treatment after drawn. Thus, the conductors 11 having the tensile strength of 400 MPa or higher can be obtained.

Example

A description of the present invention will now be specifically provided with reference to examples; however, the present invention is not limited to the examples.

[Preparation of Samples]

(1) Preparation of Conductor

In each Example, a conductor to be contained in the insulated wires was prepared. Specifically, an electrolytic copper of a purity of 99.99% or higher and master alloys containing Fe and Ti were charged in a melting pot made of a high-purity carbon, and were vacuum-melted to provide a mixed molten metal containing 1.0 mass % of Fe and 0.4 mass % of Ti. The mixed molten metal was continuously cast into a cast product of φ12.5 mm. The cast product was subjected to extrusion and rolling to have a diameter of φ8 mm, and then was drawn to provide an elemental wire of φ0.165 mm. Seven elemental wires as produced were stranded with a stranding pitch of 14 mm, and then the stranded wire was compressed. Then the compressed wire was subjected to a heat treatment where the temperature of the wire was kept at 500° C. for eight hours. Thus, a conductor having a conductor cross section of 0.13 $mm^2$ and an outer diameter of 0.45 mm was prepared.

Tensile strength and breaking elongation of the copper alloy conductor thus prepared were evaluated in accordance with JIS Z 2241. For the evaluation, the distance between evaluation points was set at 250 mm, and the tensile speed was set at 50 mm/min. According to the result of the evaluation, the copper alloy conductor had a tensile strength of 490 MPa and a breaking elongation of 8%.

As conductors for Comparative Examples, a conventional strand wire made of pure copper was used. The tensile strength, breaking elongation, conductor cross section, and outer diameter of the conductors were measured in the same manner as described above, and are shown in Table 1 and 2. The conductor cross section and outer diameter adopted for the conductors were those which can be assumed to be substantial lower limits for a pure copper electric wire defined by the limited strength of the conductors.

(2) Preparation of Insulated Wires

Insulated wires were prepared by formation of insulation coatings made of a polyethylene resin around the above-prepared copper alloy and pure copper conductors through extrusion. The thicknesses of the insulation coatings for each of Examples and Comparative Examples were as shown in Table 1 and 2.

(3) Preparation of Shielded Communication Cables Containing Braided Shield

In Examples A1 to A4 and Comparative Examples A1 and A2, two insulated wires as prepared above were twisted each other with a twist pitch of 25 mm, to provide twisted pairs. Then, braided shields were put surrounding the twisted pairs. The braided shields were made of tin-plated annealed copper wires of φ0.12 mm (i.e., 0.12TA). The number of carriers, number of wires per carrier, and pitch were selected as shown in Table 1. Then, sheaths were formed by extrusion of a polyethylene resin around the braided shields. The sheaths have a thickness of 0.4 mm. Thus, the shielded communication cables as Examples A1 to A4 and Comparative Examples A1 and A2 were prepared.

(4) Preparation of Shielded Communication Cables Having Metal Foil Shields

For Examples B1 to B4 and Comparative Examples B1 and B2, a conductive wire was prepared as a grounding wire through twisting of nine tin-plated copper elemental wires of φ0.18 mm. Then, two insulated wires as prepared above were twisted together with the grounding wire with a twist pitch of 25 mm, to provide twisted pairs. Further, metal foil shields were put surrounding the twisted pairs. Aluminum foil shields having a thickness of 0.05 mm were used as the metal foil shields. Then, sheaths were formed by extrusion of a polyethylene resin around the metal foil shields. The sheaths have a thickness of 0.4 mm. Thus, the shielded communication cables as Examples B1 to B4 and Comparative Examples B1 and B2 were prepared.

[Evaluation]

(Finished Outer Diameter)

Outer diameters of the prepared shielded communication cables were measured for evaluation of whether the diameters of the cables were successfully reduced.

(Characteristic Impedance)

Characteristic impedances of the prepared shielded communication cables were measured. The measurement was performed by the open-short method with the use of an LCR meter.

[Results]

Table 1 shows the configurations and evaluation results of the shielded communication cables containing the braided shields as Examples A1 to A4 and Comparative Examples A1 and A2. Table 2 shows the configurations and evaluation results of the shielded communication cables containing the metal foil shields as Examples B1 to B4 and Comparative Examples B1 and B2.

TABLE 1

| | Insulated Wire | | | | | | | | | | | |
|---|---|---|---|---|---|---|---|---|---|---|---|---|
| | Conductor | | | | | | | | | | | |
| | | Tensile | | Cross-sectional | Outer | Thickness of Insulation | Outer | Braided Shield | | | Finished Outer | Characteristic |
| | Material | Strength [MPa] | Elongation [%] | Area [$mm^2$] | Diameter [mm] | Coating [mm] | Diameter [mm] | *C | *W | Pitch [mm] | Diameter [mm] | Impedance [Ω] |
| Example A1 | Copper | 490 | 8 | 0.13 | 0.45 | 0.35 | 1.15 | 12 | 8 | 25 | 3.5 | 109 |
| Example A2 | Alloy | | | | | 0.30 | 1.05 | | 7 | | 3.3 | 101 |

TABLE 1-continued

| | Insulated Wire | | | | | | | | | | | |
|---|---|---|---|---|---|---|---|---|---|---|---|---|
| | Conductor | | | | | | | Braided Shield | | | | |
| | Material | Tensile Strength [MPa] | Elongation [%] | Cross-sectional Area [mm$^2$] | Outer Diameter [mm] | Thickness of Insulation Coating [mm] | Outer Diameter [mm] | *C | *W | Pitch [mm] | Finished Outer Diameter [mm] | Characteristic Impedance [Ω] |
| Example A3 | | | | | | 0.25 | 0.95 | | 7 | | 3.1 | 94 |
| Example A4 | | | | | | 0.20 | 0.85 | | 6 | | 2.9 | 90 |
| Comparative Example A1 | Pure Copper | 220 | 24 | 0.22 | 0.55 | 0.35 | 1.25 | 12 | 8 | 25 | 3.7 | 89 |
| Comparative Example A2 | | | | | | 0.30 | 1.15 | | 8 | | 3.5 | 88 |

*C: Number of carriers
*W: Number of wires per carrier

TABLE 2

| | Insulated Wire | | | | | | | | | |
|---|---|---|---|---|---|---|---|---|---|---|
| | Conductor | | | | | | | | | |
| | Material | Tensile Strength [MPa] | Elongation [%] | Cross-sectional Area [mm$^2$] | Outer Diameter [mm] | Thickness of Insulation Coating [mm] | Outer Diameter [mm] | Metal Foil Shield | Finished Outer Diameter [mm] | Characteristic Impedance [Ω] |
| Example B1 | Copper | 490 | 8 | 0.13 | 0.45 | 0.35 | 1.15 | Al, 0.05 mm | 3.2 | 109 |
| Example B2 | Alloy | | | | | 0.30 | 1.05 | (Ground Wire | 3.0 | 102 |
| Example B3 | | | | | | 0.25 | 0.95 | used) | 2.8 | 96 |
| Example B4 | | | | | | 0.20 | 0.85 | | 2.6 | 90 |
| Comparative Example B1 | Pure Copper | 220 | 24 | 0.22 | 0.55 | 0.35 | 1.25 | Al, 0.05 mm (Ground Wire | 3.4 | 90 |
| Comparative Example B2 | | | | | | 0.30 | 1.15 | unused) | 3.2 | 87 |

According to Table 1 showing the evaluation results of examples of the cable containing braided shields, Examples A1 and A2, which contain the copper alloy conductors and have the conductor cross-sectional area smaller than 0.22 mm$^2$, have higher characteristic impedances than Comparative Examples A1 and A2, which contain the pure copper conductors and have the conductor cross-sectional area of 0.22 mm$^2$, though the insulation coating of Examples A1 and A2 have the same thicknesses as those of Comparative Examples A1 and A2, respectively. Examples A1 and A2 each have characteristic impedances in the range of 100±10Ω), which is required for Ethernet communication, while Comparative Examples A1 and A2 each have particularly low impedances out of the range of 100±10Ω. Examples A3 and A4 each maintain characteristic impedance in the range of 100±10Ω) even though the insulation coating is made thinner.

The above-observed tendency in the characteristic impedances can be interpreted as a result of the smaller diameter of the copper alloy conductors and the smaller distance therebetween than those of the pure copper conductors. Consequently, the copper alloy conductors can have the small thickness of the insulation coatings smaller than 0.35 mm while ensuring the characteristic impedances of 100±10Ω); the thickness can be reduced to 0.20 mm at the minimum. Reduction of the thickness of the insulation coatings, as well as reduction of the diameter of the conductors itself, thus serves to reduce the finished outer diameter of the shielded communication cable.

For the cables containing metal foil shields as shown in Table 2, the same tendency is observed upon comparison between Examples B1 to B4 and Comparative Examples B1 and B2 as was observed for the cables containing braided shields upon comparison between Examples A1 to A4 and Comparative Examples A1 and A2. The cables containing metal foil shields have slightly smaller finished outer diameters than the cables having braided shields. This is because the metal foil shields have smaller thicknesses and can be put closer to the twisted pairs than the braided shields.

A same value of characteristic impedance is observed in Example B4 where the copper alloy wires are used as the conductors and in Comparative Example B1 where the pure copper wires were used. When the finished outer diameters in the two cases are compared, the shielded communication cable according to Example B4 has a 24% smaller finished outer diameter because of the reduction of the diameter of the conductors.

The embodiments of the present invention have been described specifically but the present invention is no way restricted to the embodiments described above but can be modified variously within a range not departing from the gist of the present invention.

1, 2 Communication cable
10 Twisted pair
11 Insulated wire
12 Conductor
13 Insulation coating
20 Braided shield
30 Sheath
40 Metal foil Shield

The invention claimed is:

1. A shielded communication cable, comprising:

a twisted pair comprising a pair of insulated wires twisted with each other, each of the insulated wire comprising:

a conductor that has a tensile strength of 400 MPa or higher; and an insulation coating that covers the conductor; and a shield that is made of a conductive material and surrounds the twisted pair, the cable having a characteristic impedance of 100±10 Ω, wherein the conductor of each of the insulated wires has a breaking elongation of 7% or higher.

2. The shielded communication cable according to claim 1, wherein each of the insulated wires has a conductor cross-sectional area smaller than 0.22 $mm^2$.

3. The shielded communication cable according to claim 1, wherein the insulation coating of each of the insulated wires has a thickness of 0.35 mm or smaller.

4. The shielded communication cable according to claim 1, wherein each of the insulated wires has an outer diameter of 1.15 mm or smaller.

5. The shielded communication cable according to claim 1, wherein the shield is a braided shield.

6. The shielded communication cable according to claim 1, wherein the shield is a metal foil shield, and the cable further comprises a grounding wire electrically continuous with the shield within an area surrounded by the shield.

7. The shielded communication cable according to claim 2, wherein the insulation coating of each of the insulated wires has a thickness of 0.35 mm or smaller.

8. The shielded communication cable according to claim 7, wherein each of the insulated wires has an outer diameter of 1.15 mm or smaller.

9. The shielded communication cable according to claim 8, wherein the shield is a braided shield.

10. The shielded communication cable according to claim 8, wherein the shield is a metal foil shield, and the cable further comprises a grounding wire electrically continuous with the shield within an area surrounded by the shield.

11. A shielded communication cable, comprising:

a twisted pair comprising a pair of insulated wires twisted with each other, each of the insulated wire comprising:

a conductor that has a tensile strength of 440 MPa or higher; and an insulation coating that covers the conductor; and a shield that is made of a conductive material and surrounds the twisted pair, the cable having a characteristic impedance of 100±10 Ω.

* * * * *